US011484060B2

(12) United States Patent
Ding et al.

(10) Patent No.: US 11,484,060 B2
(45) Date of Patent: Nov. 1, 2022

(54) EVAPORATOR AND ITS CONTROL METHOD

(71) Applicant: SHENZHEN JIANAN TECHNOLOGY CO., LIMITED, Guangdong (CN)

(72) Inventors: Jianjun Ding, Guangdong (CN); Jianhua Niu, Guangdong (CN)

(73) Assignee: SHENZHEN JIANAN TECHNOLOGY CO., LIMITED, Shenzhen (CN)

( * ) Notice: Subject to any disclaimer, the term of this patent is extended or adjusted under 35 U.S.C. 154(b) by 358 days.

(21) Appl. No.: 16/930,298

(22) Filed: Jul. 15, 2020

(65) Prior Publication Data

US 2021/0368864 A1 Dec. 2, 2021

(30) Foreign Application Priority Data

May 29, 2020 (CN) ..... 202010478066.7

(51) Int. Cl.
*A24F 13/00* (2006.01)
*A24F 40/40* (2020.01)
*A24F 40/57* (2020.01)

(52) U.S. Cl.
CPC ..... *A24F 40/40* (2020.01); *A24F 40/57* (2020.01)

(58) Field of Classification Search
CPC ..... A24F 47/00
USPC ..... 131/328–329
See application file for complete search history.

(56) References Cited

U.S. PATENT DOCUMENTS 11,051,549 B2 * 7/2021 Borkovec ..... A24F 40/44
11,129,409 B2 * 9/2021 Xiao ..... A24F 7/00

* cited by examiner

*Primary Examiner* — Phuong K Dinh

(57) ABSTRACT

An evaporator is provided, comprising a heating core shell and a heating core assembly; the heating core assembly comprises a pipe bowl container, a cavity air passage structure, a heating element and a control circuit; the control circuit is configured to heat the heating element according to received trigger signals from different trigger paths, the heating element is configured to conduct heat energy to and evaporate a matter to be evaporated stored in the pipe bowl container, and evaporated gas is guided to outside of the heating core shell through the cavity air passage structure. A control method of the evaporator is also provided. The pipe bowl container is convenient for cleaning, and the control circuit receives signals from different trigger paths to heat the heating element, so as to make the heating working state of the control and operation of the heating element more concise and convenient.

10 Claims, 7 Drawing Sheets

EVAPORATOR AND ITS CONTROL METHOD

CROSS REFERENCE TO RELATED APPLICATIONS

The present application claims the benefit of Chinese Patent Application No. 202010478066.7 filed on May 29, 2020, the contents of which are incorporated herein by reference in their entirety.

FIELD OF THE PRESENT APPLICATION

The present application relates to a field of electronic cigarette, and more particularly relates to an evaporator and its control method.

BACKGROUND OF THE PRESENT APPLICATION

The evaporator is a device for heating the evaporation medium to produce smoke for inhalation. Evaporation is an alternative to combustion (smoking) which only heats up and does not burn. It can avoid inhalation of many irritating toxic and carcinogenic by-products. In some forms, the evaporation medium is plant matter extracted in the form of oil or wax.

At present, the main way to evaporate medicine or ointment is to heat the glass or metal in form of container matched with shisha to the required temperature with a lighter, and then add the smoke or ointment to produce smoke. However, this way requires high taste control. In addition, exposed high-temperature parts are very dangerous for users. Another way is to connect the heating wire or ceramic heating plate placed in the pipe bowl container to the power supply to generate heat and evaporate the smoke or ointment. However, there are some disadvantages in this way. After use, it cannot be cleaned, resulting in a more painful burning smell after multiple use, which affects the user experience.

SUMMARY OF THE PRESENT APPLICATION

According to the problems existing in the prior art, the application provides an evaporator and a control method thereof, which is used to solve the technical problem that the air passage structure of the evaporator in the prior art is not easy to clean.

The technical scheme of the application for the above technical problems is as follows:

An evaporator wherein comprising a heating core shell, and a heating core assembly arranged in the heating core shell and adaptive connected with the heating core shell;

wherein the heating core assembly comprises a pipe bowl container, a cavity air passage structure penetrating a bottom of the pipe bowl container and extending along two sides of the bottom of the pipe bowl container, a heating element arranged outside the bottom of the pipe bowl container, and a control circuit electrically connected to the heating element;

wherein the control circuit is configured to heat the heating element according to received trigger signals from different trigger paths, the heating element is configured to conduct heat energy to and evaporate a matter to be evaporated and stored in the pipe bowl container, and evaporated gas is guided to outside of the heating core shell through the cavity air passage structure.

According to the above evaporator, the cavity air passage structure comprises a first air passage extending in an inner space of the pipe bowl container and a second air passage extending away from outside of the bottom of the pipe bowl container and communicating with the first air passage, and the annular heating element is sleeved around the second air passage and is in contact with and fixed to an outer surface of the bottom of the pipe bowl container.

According to the above evaporator, the heating core assembly further comprises an inner electrode sleeved on outer periphery of the second air passage and an outer electrode arranged in isolation from the inner electrode, contacts of two ends of the heating element are respectively electrically connected with the inner electrode and the outer electrode, the heating element is electrically connected with the battery cell and the control circuit through the inner electrode and the outer electrode, the battery cell is communicated with the heating element through the contacts to convert electric energy into thermal energy.

According to the above evaporator, the heating core assembly further comprises a heat-insulation support, a heat-insulation gasket and a buffering gasket successively arranged on one side of the heating element away from the pipe bowl container, the buffering gasket and the heat-insulation gasket are in a ring shape and are sequentially sleeved on the outer electrode, one end of the heat-insulation support abuts against the heat-insulation gasket, the other end of the heat-insulation support abuts and fixes the heating element on the outside of the bottom of the pipe bowl container.

According to the above evaporator, the evaporator further comprises an electrode outside of bracket and an electrode inside of bracket arranged in isolation, one end of the electrode outside of bracket is electrically connected with the outer electrode, one end of the electrode inside of bracket is electrically connected with the inner electrode, the other end of the electrode outside of bracket and the other end of the electrode inside of bracket are electrically connected with the battery cell and the control circuit;

a ceramic air passage structure is detachably connected inside the electrode inside of bracket, one end of the ceramic air passage structure is communicated with the second air passage, the other end of the ceramic air passage structure is connected with a hollow connector configured for connecting with a shisha.

According to the above evaporator, one side of an opening end of the pipe bowl container is provided with a magnetic attraction part which can be used for magnetic suction connection with a cover body, the magnetic attraction part is supported by a top of the heating core shell and is extruded and connected with an inner wall of the heating core shell, a heat-insulation ring is provided between the magnetic attraction part and the opening end of the pipe bowl container; the cover body is provided with an air inlet communicated with the cavity air passage structure.

According to the above evaporator, the evaporator further comprises a housing and a switch assembly arranged on the housing, the switch assembly comprises a switch button and a display touch button, the switch button and the display touch button are electronically connected with the control circuit, the control circuit can receive any triggering command of the switch button and the display touch button.

According to the above evaporator, the evaporator further comprises a motor arranged inside the housing, the motor is electrically connected with the control circuit, the control circuit is configured to output a control signal to the motor according to the heating temperature of the heating element to control a vibration of the motor, and to indicate a heating working state of the heating element.

According to the above evaporator, the evaporator further comprises a current sampling circuit and an amplifier;

one end of the current sampling circuit is electronically connected with the heating element, the other end of the current sampling circuit is electronically connected with the amplifier, the amplifier is electronically connected with the control circuit;

the current sampling circuit is configured to obtain a current signal of the heating element, the amplifier is configured to amplify the obtained current signal, and the current signal amplified by the amplifier is transmitted to the control circuit.

Another object of the application is also to provide a control method of the evaporator described above, comprising:

step S100: receiving a trigger signal from one of different trigger paths, the trigger paths at least comprise a switch button triggering and a display touch button triggering;

step S200: according to the trigger signal, controlling a working state of the heating element;

step S300: obtaining a heating temperature of the heating element, and controlling a vibration state of the motor according to the heating temperature of the heating element to indicate a heating working state of the heating element and automatically adjust a temperature of the heating element.

The beneficial effects of the evaporator provided by the present application are at least:

(1) the cavity air passage structure which penetrates the bottom of the pipe bowl container and extends along both sides of the bottom of the pipe bowl container makes the evaporated gas easier to be absorbed by the user, and is convenient for cleaning the pipe bowl container, and the independence and purity of the cavity air passage structure can be ensured, which will not produce the hard burning smell after multiple use, thus improving the user experience;

(2) the heating element independently arranged on the outside of the bottom of the pipe bowl container is not only convenient for cleaning the pipe bowl container, but also makes the evaporated gas in the household for inhalation not pass through the heating element, avoiding the risk of inhaling metal ions to affect the health of users, making it safer; moreover, the heating element is closely contacted with the outside of the bottom of the pipe bowl container, which can prevent heat loss and improve the evaporation efficiency;

(3) the control circuit connected with the heating element can receive signals from different trigger paths to heat the heating element, so that the heating working state of the heating element can be controlled and operated more succinctly and conveniently.

The beneficial effects of the control method of the evaporator provided by the present application are at least:

it can receive signals from different trigger paths to heat the heating element, which makes it more convenient to control and operate the heating working state of the heating element, and indicate the working state of the heating element through the vibration state of the motor, so that the user can quickly know the heating working state of the heating element, and automatically adjust the temperature state of the heating element as required.

BRIEF DESCRIPTION OF THE DRAWINGS

In order to more clearly illustrate the embodiments of the present application, the drawings used in the embodiments will be briefly described below. Obviously, the drawings in the following description are only some embodiments of the present application, and those skilled in the art can obtain other drawings according to the provided drawings without any creative work.

Figure 1:
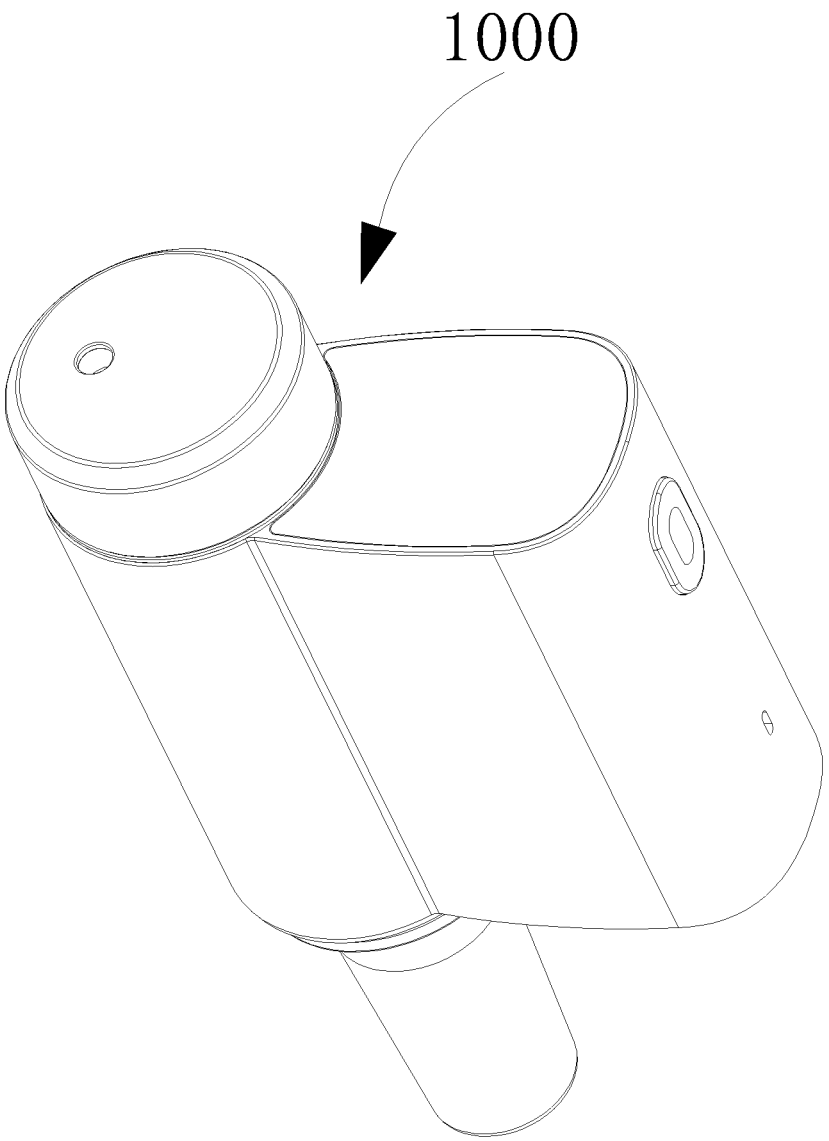
FIG. 1 is a schematic structural view of the evaporator provided by the embodiment of the present application.

Among them, the reference signs in the figure:

| | |
|---|---|
| 1000 | evaporator |
| 10 | heating core shell |
| 20 | heating core assembly |
| 21 | pipe bowl container |
| 22 | cavity air passage structure |
| 221 | first air passage |
| 222 | second air passage |
| 23 | heating element |
| 231 | first wire |
| 232 | second wire |
| 24 | inner electrode |
| 25 | outer electrode |
| 26 | first insulating ring |
| 27 | first silicone sealing ring |
| 28 | heat-insulation support |
| 281 | abutment plate |
| 2811 | first connecting hole |
| 2812 | second connecting hole |
| 282 | bracket foot |
| 29 | heat-insulation gasket |
| 30 | buffering gasket |
| 31 | magnetic attraction part |
| 32 | heat-insulation ring |
| 40a | electrode outside of bracket |
| 40b | electrode inside of bracket |
| 40c | second insulating ring |
| 40d | second silicone sealing ring |
| 50 | ceramic air passage structure |
| 60 | hollow connector |
| 61 | sealing raised line |
| 70 | cover body |
| 71 | magnet |
| 72 | air inlet |
| 80 | housing |
| 90 | control circuit |
| 100 | battery cell |
| 110 | switch assembly |
| 111 | switch button |
| 112 | display touch button |
| 1121 | conductive foam |
| 1122 | lens |
| 1123 | fixed bracket |
| 1124 | light guiding silica gel |
| 1125 | etching plate |
| 130 | electronic switch |

-continued

| | |
|---|---|
| 140 | power indicator |
| 150 | USB interface |
| 160 | motor |
| 170 | current sampling circuit |
| 180 | amplifier |

DETAILED DESCRIPTION OF THE PREFERRED EMBODIMENT

It should be noted that when a part is called "fixed to" or "disposed to" another part, it can be directly or indirectly located on the other part. When a part is called "connected" to another part, it can be directly or indirectly connected to the other part. The directions or positions indicated by the terms "up", "down", "left", "right", "front", "back", "vertical", "horizontal", "top", "bottom", "inside", "outside" are based on the directions or positions shown in the attached drawings. They are only for the convenience of description and cannot be understood as the limitations of the technical scheme. The terms "first" and "second" are used for descriptive purposes only and cannot be understood as indicating or implying relative importance or implying the number of technical features. "Multiple" means two or more, unless otherwise specified.

In order to solve the problem that the air passage structure of the evaporator in the prior art is not easy to clean, in addition, in the current ointment evaporator, a key is set to control the opening and closing of the evaporator, as well as the output power and heating time, but in fact, when the evaporator is heated, the temperature of the whole evaporator is very high, when the user holds the evaporator on his hand and operates it by pressing the key, he will obviously feel the temperature of the evaporator itself, and the operation is not convenient. The application aims to provide an evaporator, the core idea of which is: a heating core assembly is provided, the heating core assembly comprises a pipe bowl container and a cavity air passage structure which penetrates the bottom of the pipe bowl container and extends along both sides of the bottom of the pipe bowl container, making the evaporated gas easier to be absorbed by the user, and convenient for cleaning the pipe bowl container, and ensuring the independence and purity of the cavity air passage structure; the heating core assembly further comprises a heating element independently arranged on the outside of the bottom of the pipe bowl container which is not only convenient for cleaning the pipe bowl container, but also makes the evaporated gas in the household for inhalation not pass through the heating element, avoiding the risk of inhaling metal ions to affect the health of users, making it safer; a control circuit connected with the heating element which is configured to according to the received trigger signals from different trigger paths to heat the heating element, making the heating working state of the heating element be controlled and operated more succinctly and conveniently.

In order to make the technical problems, technical solutions and beneficial effects to be solved by the application clearer and clearer, the application will be further described in detail below in combination with the drawings and embodiments. It should be understood that the specific embodiments described herein are only for the interpretation of the application and are not for the limitation of the application.

Refer to FIG. 1, an evaporator 1000 is provided by the embodiment. Specifically, please refer to 2 and 3 together, it comprises a heating core shell 10, a heating core assembly 20 arranged in the heating core shell 10 and adaptive connected with the heating core shell 10;

the heating core assembly 20 comprises a pipe bowl container 21, a cavity air passage structure 22 penetrating a bottom of the pipe bowl container 21 and extending along two sides of the bottom of the pipe bowl container 21, a heating element 23 arranged outside the bottom of the pipe bowl container 21, and a control circuit 90 electrically connected to the heating element 23 (please refer to FIG. 4 here); the control circuit 90 is configured to heat the heating element 23 according to received trigger signals from different trigger paths, the heating element 23 is configured to conduct heat energy to and evaporate a matter to be evaporated stored in the pipe bowl container 21, and evaporated gas is guided to outside of the heating core shell 10 through the cavity air passage structure 22.

The working principle of the evaporator provided in the embodiment can be:

the evaporator 1000 provided by the present embodiment, the control circuit 90 connected with the heating element 23 can receive signals from different trigger paths to heat the heating element 23, making the control circuit 90 accept a variety of trigger signals, and operate and control the heating working state of the heating element 23 in a variety of trigger modes, making the operation more concise and convenient;

the heating element 23 is independently arranged on the outside of the bottom of the pipe bowl container 21, which is further convenient for cleaning the pipe bowl container 21, at the same time, the heating element 23 is not in direct contact with the substance to be evaporated stored in the tobacco pot container 21, making the evaporated gas in the household for inhalation not pass through the heating element 23, avoiding the risk of inhaling metal ions to affect the health of users, making it safer; moreover, the heating element 23 is closely contacted with the outside of the bottom of the pipe bowl container 21, the heat energy of the heating element 23 can also be directly transmitted to the pipe bowl container 21 which is in close contact with the heating element 23, and the heat of the substance to be evaporated stored in the pipe bowl container 21 is heated to produce the evaporated gas, which can prevent heat loss and improve the evaporation efficiency;

the cavity air passage structure 22 penetrates the bottom of the pipe bowl container 21 and extends along both sides of the bottom of the pipe bowl container 21, making the evaporation gas generated by the evaporation of the substance to be evaporated can be led to the outside of the heating core shell 10 through the cavity air passage structure 22 when heating the substance to be evaporated in the pipe bowl container 21; The arrangement of the cavity air passage structure 22 not only facilitates the cleaning of the pipe bowl container 21, but also ensures the independence and purity of the cavity air passage structure 22.

The beneficial effects of the evaporator provided by the present embodiment are at least:

(1) the evaporator provided by the present embodiment, the cavity air passage structure 22 which penetrates the bottom of the pipe bowl container 21 and extends along both sides of the bottom of the pipe bowl container 21 makes the evaporated gas easier to be absorbed by the user, and is convenient for cleaning the pipe bowl container, and the independence and purity of the cavity air passage structure 22 can be ensured, which will not produce the hard burning smell after multiple use, thus improving the user experience;

(2) the heating element 23 independently arranged on the outside of the bottom of the pipe bowl container 21 is not only convenient for cleaning the pipe bowl container 21, but also makes the evaporated gas in the household for inhalation not pass through the heating element 23, avoiding the risk of inhaling metal ions to affect the health of users, making it safer; moreover, the heating element 23 is closely contacted with the outside of the bottom of the pipe bowl container 21, which can prevent heat loss and improve the evaporation efficiency;

(3) the control circuit 90 connected with the heating element 23 can receive signals from different trigger paths to heat the heating element 23, so that the heating working state of the heating element 23 can be controlled and operated more succinctly and conveniently.

Alternatively, in order to further facilitate the cleaning of the pipe bowl container 21, the cavity air passage structure 22 can be arranged in the center position of the pipe bowl container 21. Alternatively, the cavity air passage structure 22 can also be arranged on the side wall of the pipe bowl container 21. It should be understood that the cavity air passage structure 22 can also be arranged in other positions of the pipe bowl container 21, not limited to the above situations, and there is no limitation here.

Optionally, the substance to be evaporated is ointment. It should be understood that the substance to be evaporated can also be other substances, which is not limited to the above situation and is not limited here.

Alternatively, the pipe bowl container 21 is made of quartz material. The pipe bowl container 21 can also be other materials, which is not limited to the above situation and is not limited here.

Figure 2:
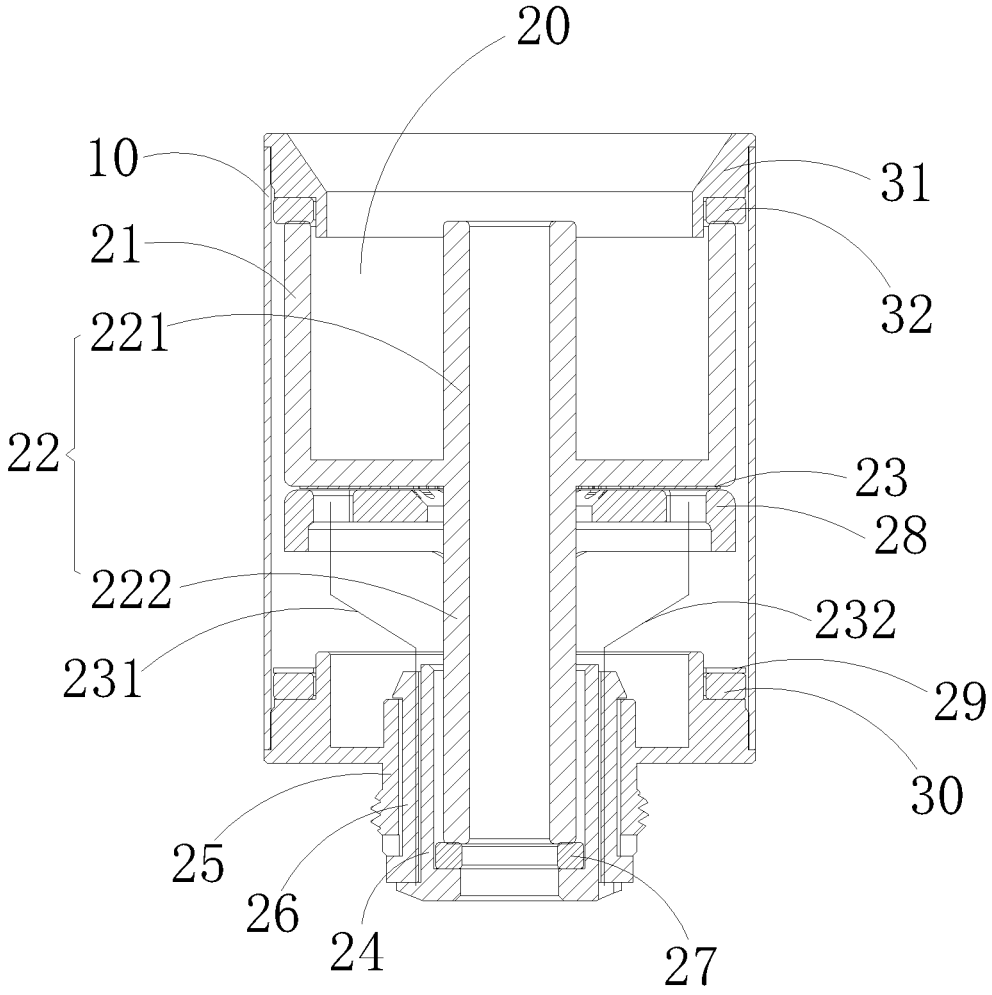
FIG. 2 is a sectional schematic structural view of the heating core shell and the heating core assembly provided by the embodiment of the present application.
Figure 3:
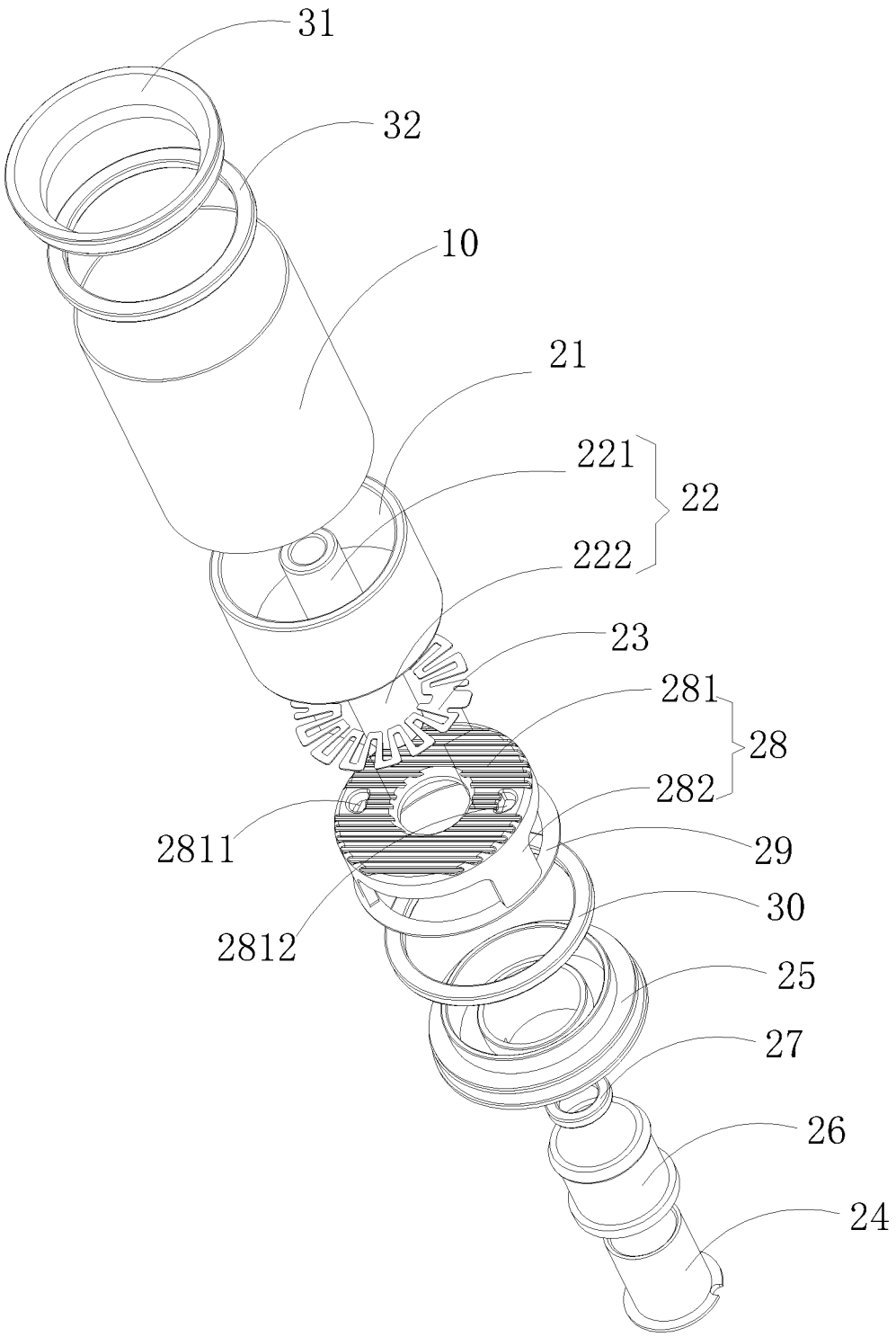
FIG. 3 is an explosion schematic structural view of the heating core shell and the heating core assembly provided by the embodiment of the present application.

Specifically, please continue to refer to FIG. 2 and FIG. 3, the cavity air passage structure 22 comprises a first air passage 221 extending in an inner space of the pipe bowl container 21 and a second air passage 222 extending away from outside of the bottom of the pipe bowl container 21 and communicating with the first air passage 221, and the annular heating element 23 is sleeved around the second air passage 222 and is in contact with and fixed to an outer surface of the bottom of the pipe bowl container 21. The annular heating element 23 is set on the second air passage 222, so that the heating element 23 will not shake at will, and can be stably fixed on the outer side of the bottom of the pipe bowl container 21, thereby improving the heating efficiency of the heating element 23 to the pipe bowl container 21.

Figure 4:
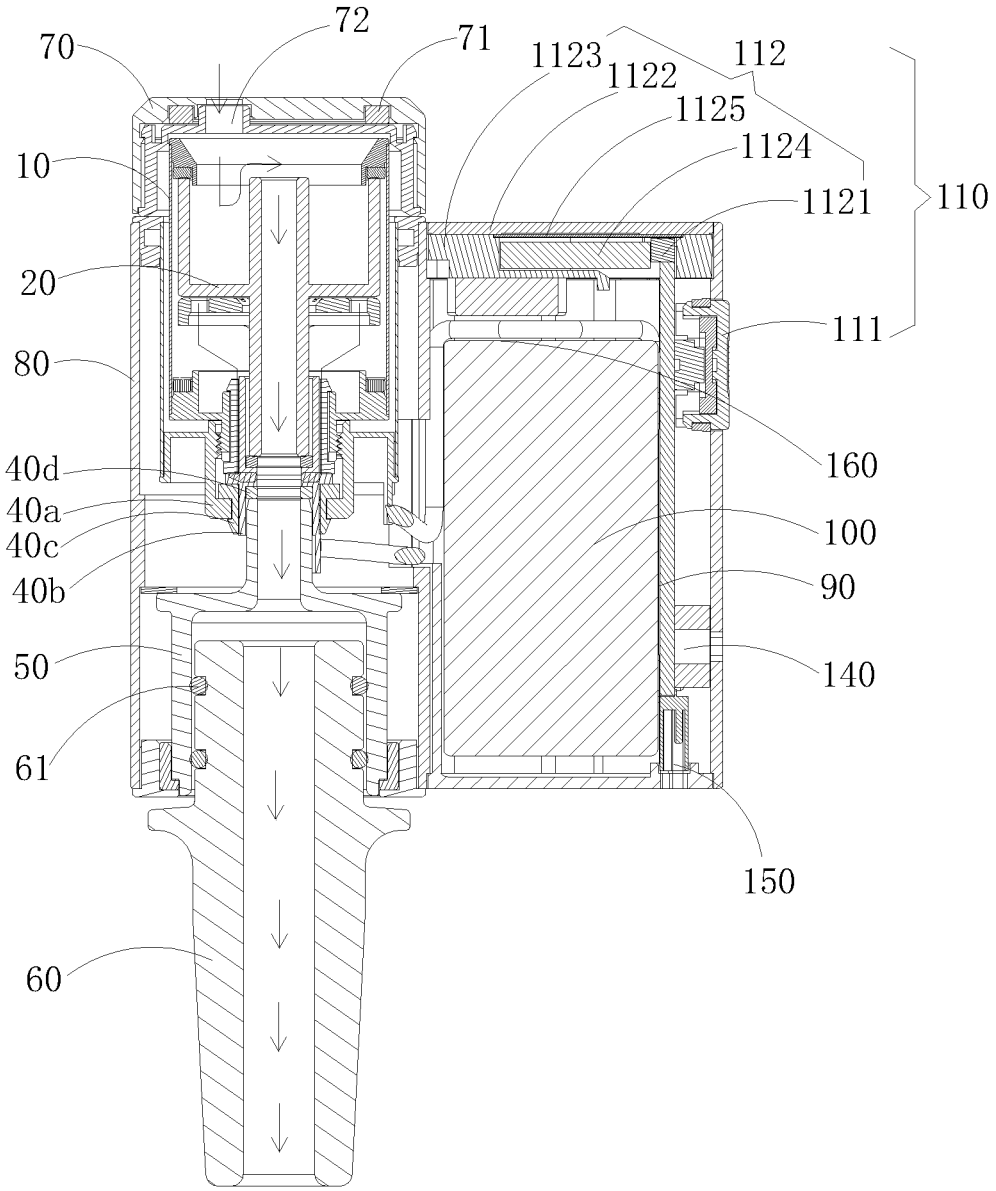
FIG. 4 is a sectional schematic structural view of the evaporator provided by the embodiment of the present application.

Specifically, please continue to refer to FIG. 2 and FIG. 3, the heating core assembly 20 further comprises an inner electrode 24 sleeved on outer periphery of the second air passage 222 and an outer electrode 25 arranged in isolation from the inner electrode 24, contacts of two ends of the heating element 23 are respectively electrically connected with the inner electrode 24 an the outer electrode 25 via two conductive wires, the heating element 23 is electrically connected with the battery cell 100 and the control circuit 90 through the inner electrode 24 and the outer electrode 25, the battery cell 100 is connected with the heating element 23 through one of the contacts to convert electric energy into thermal energy (please refer to FIG. 4 together here). The generated heat energy is transmitted to the pipe bowl container 21 which is in close contact with the heating element 23, so that the temperature in the pipe bowl container 21 increases, and then the evaporation gas is generated by heating the substance to be evaporated. Alternatively, the outer electrode 25 is sleeved on the outer side of the inner electrode 24, and a first insulating ring 26 is sleeved between the inner electrode 24 and the outer electrode 25. Alternatively, the inner part of the inner electrode 24 is provided with a first silicone sealing ring 27. When the end of the second air passage 222 far away from the side of the pipe bowl container 21 is connected to the inner electrode 24, the first silicone sealing ring 27 is used for butt sealing, so that the evaporated gas flows along the preset gas channel.

Specifically, please continue to refer to FIG. 2 and FIG. 3, the heating core assembly 20 further comprises a heat-insulation support 28, a heat-insulation gasket 29 and a buffering gasket 30 successively arranged on one side of the heating element 23 away from the pipe bowl container 21, the buffering gasket 30 and the heat-insulation gasket 29 are in a ring shape and are sequentially sleeved on the outer electrode 25, one end of the heat-insulation support 28 abuts against the heat-insulation gasket 29, the other end of the heat-insulation support 28 abuts and fixes the heating element 23 on the outside of the bottom of the pipe bowl container 21. The heat-insulation support 28 is not only used to support the heating part 23, so that the heating part 23 can be tightly connected to the outside of the bottom of the pipe bowl container 21, to prevent heat loss to improve the evaporation efficiency, but also used to isolate the heat transfer to the side away from the pipe bowl container 21.

Alternatively, the heat-insulation support 28 includes an integral forming abutment plate 281 and a bracket foot 282, the abutment plate 281 is closely connected with the heating element 23 to the bottom outside of the pipe bowl container 21, to prevent heat loss to improve the evaporation efficiency, the bracket foot 282 is supported on the heat-insulation gasket 29, to reduce the contact area of the heat-insulation support 28 and the heat insulation gasket 29, and further reduce the heat conduction to the heat insulation gasket 29. The heat insulation gasket 29 can further insulate the heat conduction to the buffering gasket 30, and form a heat dissipation space between the heat insulation gasket 29 and the abutment plate 281, which can further reduce the heat conduction. Alternatively, the number of the bracket foot 282 is three, and the uniform ring is arranged at the edge of the abutment plate 281. It should be understood that the number of bracket foot 282 can be other values, not limited to the above situations, and there is no limit here.

Alternatively, the abutment plate 281 is provided with a first connecting hole 2811 and a second connecting hole 2812, the first wire 231 of the heating element 23 is electrically connected with the outer electrode 25 through the first connecting hole 2811, and the second wire 232 of the heating element 23 is electrically connected with the inner electrode 24 through the second connecting hole 2812. The setting of the first connecting hole 2811 and the second connecting hole 2812 can avoid the short-circuit phenomenon of the first wire 231 and the second wire 232 colliding together because of the transportation process or vibration of the evaporator.

Specifically, please refer to FIG. 4, the evaporator 1000 further comprises an electrode outside of bracket **40*a* and an electrode inside of bracket 40*b* arranged in isolation, one end of the electrode outside of bracket 40*a* is electrically connected with the outer electrode 25, one end of the electrode inside of bracket 40*b* is electrically connected with the inner electrode 24, the other end of the electrode outside of bracket 40*a* and the other end of the electrode inside of bracket 40*b* are electrically connected with the battery cell 100 and the control circuit 90; a ceramic air passage structure 50 is detachably connected inside the electrode inside of bracket 40*b*, one end of the ceramic air passage structure 50** is communicated with the second air passage 222, the other end of the ceramic air passage structure 50 is connected with a hollow connector 60 configured for connecting with a shisha. Alternatively, the electrode outside of bracket 40*a* is sleeved on the outer side of the electrode inside of bracket 40*b*, and a second insulating ring 40*c* is sleeved between the electrode inside of bracket 40*b* and the electrode outside of bracket 40*a*. Alternatively, a second silicone sealing ring 40*d* is arranged inside the electrode inside of bracket 40*b*, and when the end of the ceramic air passage structure 50 is connected with the electrode inside of bracket 40*b*, the inner evaporated gas flowing in the second air passage 222 can completely flow into the ceramic air passage structure 50 by the sealing of the second silicone sealing ring 40*d*. Alternatively, sealing raised line 61 is ring-shaped on the outer side wall of the hollow connector 60, and when the hollow connector 60 is connected with the inner wall of the ceramic air passage structure 50, the sealing raised line 61 is pressed and connected to the inner side wall of the ceramic air passage structure 50, not only making the connection between the hollow connector 60 and the ceramic air passage structure 50 stable, but also making the evaporation gas flowing into the ceramic air passage structure 50 flow into the hollow connector 60 completely.

Specifically, please continue to refer to FIG. 4, one side of an opening end of the pipe bowl container 21 is provided with a magnetic attraction part 31 which can be used for magnetic suction connection with a cover body 70, the magnetic attraction part 31 is supported by a top of the heating core shell 10 and is extruded and connected with an inner wall of the heating core shell 10, a heat-insulation ring 32 is provided between the magnetic attraction part 31 and the opening end of the pipe bowl container 21, the setting of the heat-insulation ring 32 can prevent the heat transfer of the pipe bowl container 21 to the magnetic attraction part 31. Alternatively, a magnet 71 is arranged inside the cover body 70, so that the cover body 70 can be magnetically connected to the heating core assembly 20. Alternatively, the cover body 70 is provided with an air inlet 72 communicated with the cavity air passage structure 22, making the outside communicating with the cavity air passage structure 22.

Figure 5:
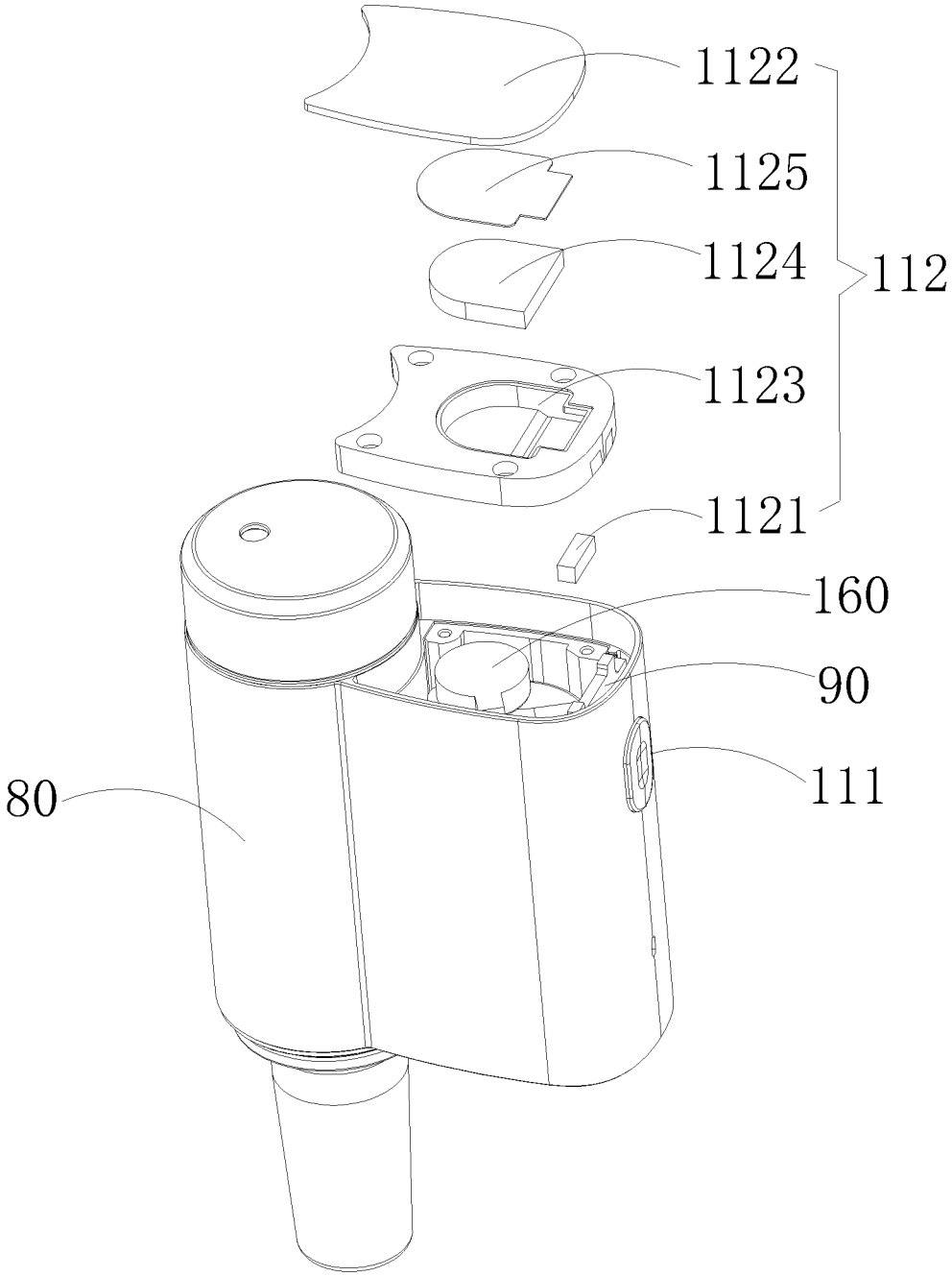
FIG. 5 is an explosion schematic structural view of the evaporator provided by the embodiment of the present application.

Specifically, please refer to FIG. 4 and FIG. 5 in combination, the evaporator 1000 further comprises a housing 80 and a switch assembly 110 arranged on the housing 80, the switch assembly 110 comprises a switch button 111 and a display touch button 112 (refer to FIG. 6 for combination here), the switch button 111 and the display touch button 112 are electronically connected with the control circuit 90, the control circuit 90 can receive any triggering command of the switch button 111 and the display touch button 112. The setting of the switch button 111 and the display touch button 112 realizes the dual operation mode. In order to avoid the hot hand phenomenon caused by the high temperature of the evaporator, the user can realize multiple operations such as power control, heating, start and stop, etc. by lightly touching the display touch button 112, which simplifies the operation and is convenient for use.

Optionally, please continue to refer to FIG. 4 and FIG. 5, the display touch button 112 includes a conductive foam 1121 and a lens 1122. The conductive foam 1121 is electrically connected with the control circuit 90, and the lens 1122 is arranged above the conductive foam 1121. When the user touches the lens 1122, the conductive foam 1121 can sense the touch, transmit the touch signal to the touch IC on the control circuit 90, and control the touch IC to carry out corresponding operation. The display touch button 112 also includes a fixed bracket 1123, a light guiding silica gel 1124 and an etching plate 1125. The light guiding silica gel 1124 and the conductive foam 1121 are arranged on the fixed bracket 1123, the etching plate 1125 is arranged on the top of the light guiding silica gel 1124 and the conductive foam 1121, and the lens 1122 is arranged on the top of the etching plate 1125. The light guiding silica gel 122 can export the light (not shown in the figure, the same below) of the LED light set on the control circuit and display it through the lens. The touch light indication of the display touch button 112 can display the set pattern through the silk screen of the lens 1122 or the etching plate 1213 below the lens 1122.

Alternatively, the evaporator 1000 also includes an electronic switch 130, which is connected with the control circuit 90 to control whether the heating element 23 enters the heating state. Alternatively, the evaporator 1000 also includes a power indicator 140, which is connected with a control circuit 90 to indicate the power on condition of the evaporator 1000. Alternatively, the evaporator 1000 also includes a USB interface 150 electrically connected to the control circuit 90.

Figure 6:
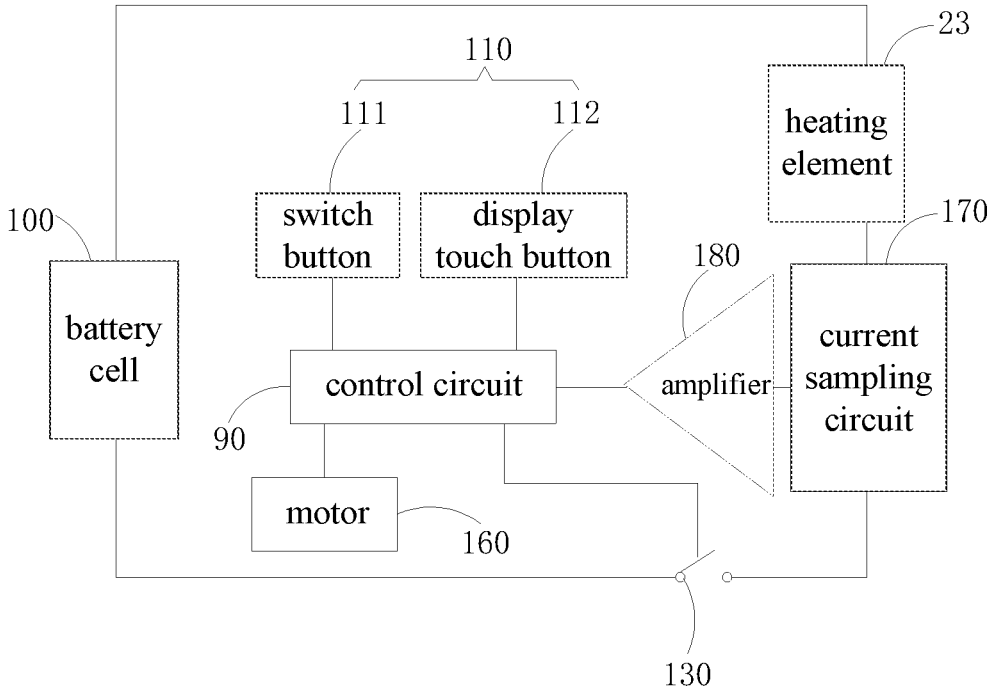
FIG. 6 is a schematic structural diagram of the circuit principle of an evaporator provided by an embodiment of the present application.

Specifically, please continue to refer to FIG. 4 and FIG. 5 in combination, the evaporator 1000 further comprises a motor 160 arranged inside the housing 80, the motor 160 is electrically connected with the control circuit 90, the control circuit 90 is configured to output a control signal to the motor 160 according to the heating temperature of the heating element 23 to control a vibration of the motor 160, and to indicate a heating working state of the heating element 23 (please refer to FIG. 6 in combination). Alternatively, the user can determine the heating working state of the heating element 23 according to the vibration frequency of the motor 160.

Specifically, please refer to FIG. 6, the evaporator 1000 further comprises a current sampling circuit 170 and an amplifier 180; one end of the current sampling circuit 170 is electronically connected with the heating element 23, the other end of the current sampling circuit 170 is electronically connected with the amplifier 180, the amplifier 180 is electronically connected with the control circuit 90; the current sampling circuit 170 is configured to obtain a current signal of the heating element 23, the amplifier 180 is configured to amplify the obtained current signal, and the current signal amplified by the amplifier 180 is transmitted to the control circuit 90. The control circuit 90 can determine the relationship between the resistance value and the temperature of the heating element 23 according to the received current signal. The larger the resistance value of the heating element 23 is, the higher the heating temperature of the heating element 23 is, the smaller the resistance value of the heating element 23 is, and the lower the heating temperature of the heating element 23 is.

Figure 7:
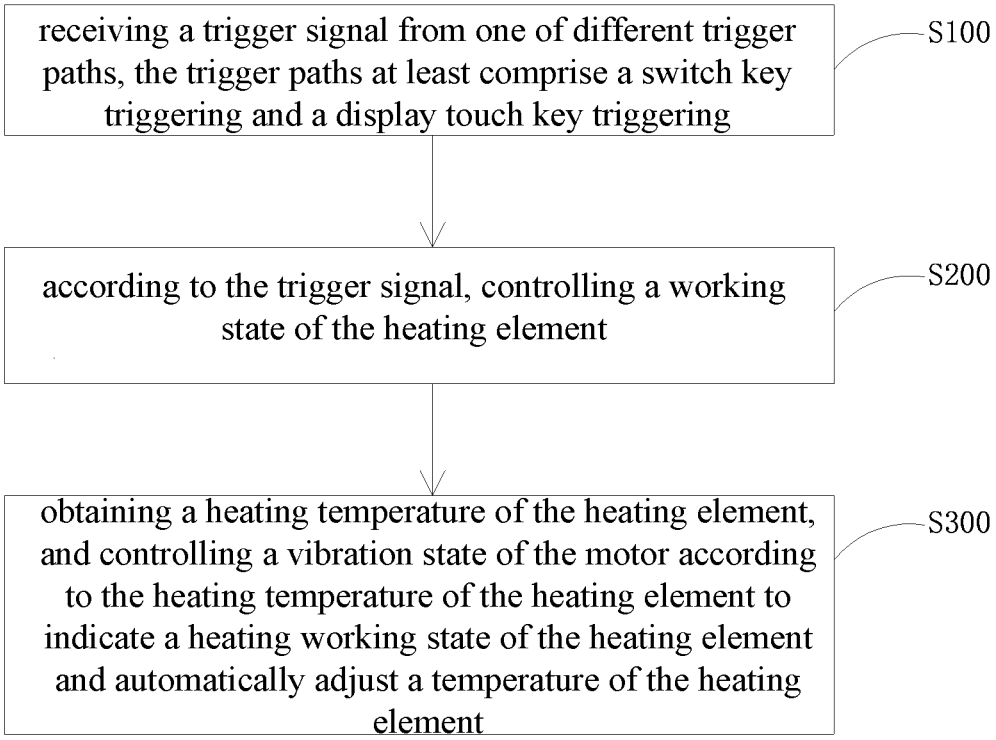
FIG. 7 is a flow chart of a control method of the evaporator provided by an embodiment of the present application.

Refer to FIG. 7, and refer to FIG. 6 in combination, a control method for the evaporator is also provided by the embodiment, comprising:

step S100: receiving a trigger signal from one of different trigger paths, the trigger paths at least comprise a switch button 111 triggering and a display touch button 112 triggering. In the use process, the user can control the evaporator through the switch button 111 or the display touch button 112. At this time, the evaporator can obtain the corresponding trigger signal through the switch button 111 or the display touch button 112.

step S200: according to the trigger signal, controlling a working state of the heating element 23. Alternatively, the trigger signal includes starting, stopping, controlling the power of the evaporator, controlling the heating time. Correspondingly, the working state of the heating element is also adjusted accordingly, so as to control the start and stop of the evaporator, controlling the power of the evaporator, controlling the heating time, etc.

step S300: obtaining a heating temperature of the heating element 23, and controlling a vibration state of the motor 160 according to the heating temperature of the heating element 23 to indicate a heating working state of the heating element 23 and automatically adjust a temperature of the heating element 23. Thus, the user can judge the temperature of the heating element 23 in the evaporator according to the vibration state of the motor in the evaporator.

Figure 8:
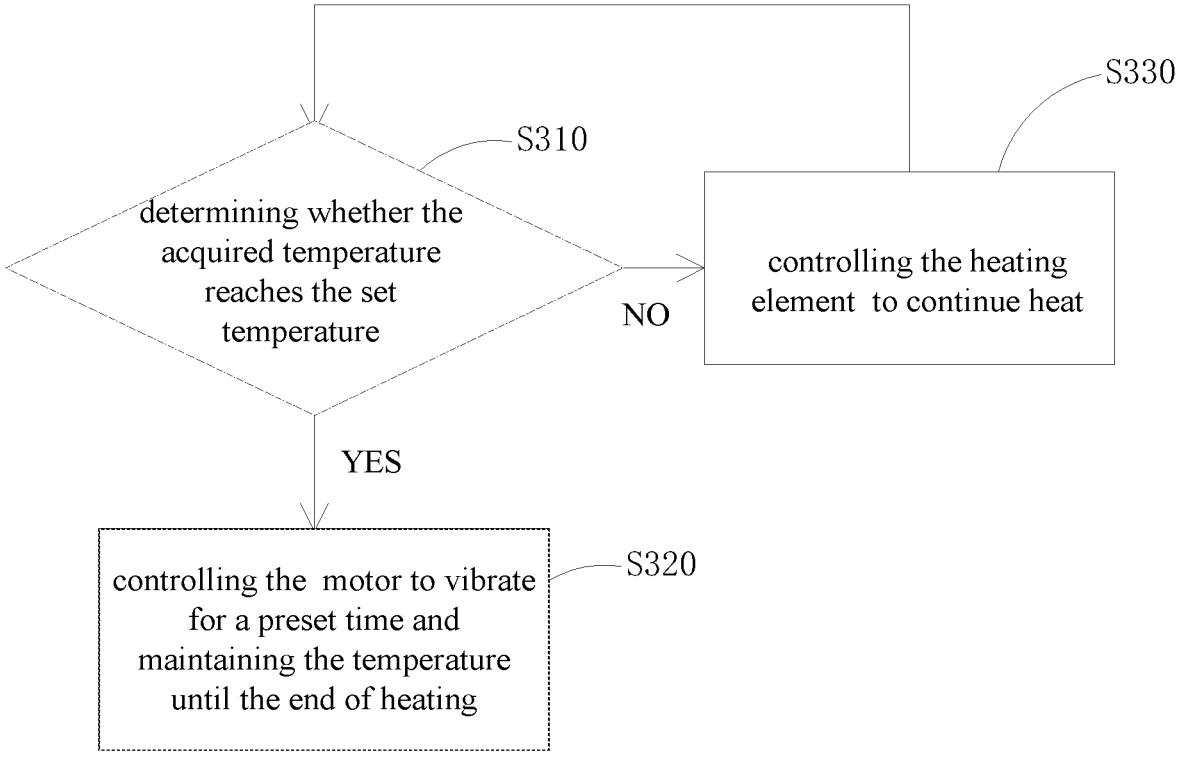
FIG. 8 is a flow chart of determining and obtaining a heating temperature in the control method of an evaporator according to an embodiment of the present application.

Specifically, in order to automatically adjust the temperature of the heating element 23, according to the relationship between the temperature of the heating element 23 in the evaporator 1000 and the resistance, the relationship between the resistance of the heating element 23 and the collected current, and the relationship between the temperature of the heating element 23 and the vibration of the motor 160, the relationship or correlation table between the above parameters can be constructed in advance, and the relationship or correlation table can be stored in a storage unit of the control circuit 90. The correlation table includes the correlation among the above parameters, including the temperature of heating element 23, the resistance value of heating element 23, the collected current value, the vibration of motor 160, etc. In the heating process of the heating element 23, the current sampling circuit 170 collects the current signal, which is amplified by the amplifier 180 and sent to the control circuit 90. The control circuit 90 calculates, analyzes and compares the current signal with the pre-built correlation table or obtains the temperature of the heating element 23 according to the relationship, and controls the vibration of the motor 160 according to the different results (when the preset temperature is reached, the vibration of motor 160 will be controlled, and the vibration will stop after the preset time. If the temperature is not reached, the motor will not vibrate), prompts the working state of heating element 23, and automatically adjust the heating temperature according to the comparison between the actual value and the theoretical value. Of course, with regard to the vibration control of motor 160, the vibration of motor 160 can also be used to indicate the working state. when the evaporator is switched on and off Please refer to FIG. 8, and refer to FIG. 6 in combination, step S300 may specifically include:

Step S310, determining whether the acquired temperature reaches the set temperature, if yes, go to step S320, if no, go to step S330;

Step S320, controlling the vibration of the motor. The motor vibrates for a preset time and maintains the temperature until the end of heating. Optionally, the preset time of the motor vibration is 2 ms-5 ms. Alternatively, the preset time of the motor vibration is 2 ms or 3 ms or 4 ms or 5 ms. It should be understood that the preset time of the motor vibration is not limited to the above situation, but may be other situations, which is not limited here.

Step S330, controlling the heating element 23 to continue heating and return to step S310.

The beneficial effects of the control method of the evaporator provided by the present embodiment are at least:

the control method of the evaporator provided by the present embodiment, signals from different trigger paths to heat the heating element 23 are received, which makes it more convenient to control and operate the heating working state of the heating element 23, and indicate the working state of the heating element 23 through the vibration state of the motor 160, so that the user can quickly know the heating working state of the heating element 23, and automatically adjust the temperature state of the heating element 23 as required.

The above is only a better embodiment of the application, and does not limit the application. Any modification, equivalent replacement and improvement made within the spirit and principles of the application shall be included in the protection scope of the application.

The invention claimed is:

1. An evaporator (1000), comprising a heating core shell (10), and a heating core assembly (20) arranged in the heating core shell (10) and adaptive connected with the heating core shell (10);

wherein the heating core assembly (20) comprises a pipe bowl container (21), a cavity air passage structure (22) penetrating a bottom of the pipe bowl container (21) and extending along two sides of the bottom of the pipe bowl container (21), a heating element (23) arranged outside the bottom of the pipe bowl container (21), and a control circuit (90) electrically connected to the heating element (23); and wherein the control circuit (90) is configured to heat the heating element (23) according to received trigger signals from different trigger paths, the heating element (23) is configured to conduct heat energy to and evaporate a matter to be evaporated and stored in the pipe bowl container (21), and evaporated gas is guided to outside of the heating core shell (10) through the cavity air passage structure (22).

2. The evaporator according to claim 1, wherein the cavity air passage structure (22) comprises a first air passage (221) extending in an inner space of the pipe bowl container (21) and a second air passage (222) extending away from outside of the bottom of the pipe bowl container (21) and communicating with the first air passage (221), and the heating element (23) in a ring shape is sleeved around the second air passage (222) and is in contact with and fixed to an outer surface of the bottom of the pipe bowl container (21) .

3. The evaporator according to claim 2, wherein the heating core assembly (20) further comprises an inner electrode (24) sleeved on outer periphery of the second air passage (222) and an outer electrode (25) arranged in isolation from the inner electrode (24), contacts of two ends of the heating element (23) are respectively electrically connected with the inner electrode (24) and an the outer electrode (25), the heating element (23) is electrically connected with a battery cell (100) and the control circuit (90) through the inner electrode (24) and the outer electrode (25), the battery cell (100) is communicated with the heating element (23) through the contacts to convert electric energy into thermal energy.

4. The evaporator according to claim 3, wherein the heating core assembly (20) further comprises a heat-insulation support (28), a heat-insulation gasket (29) and a buffering gasket (30) successively arranged on one side of the heating element (23) away from the pipe bowl container (21), the buffering gasket (30) and the heat-insulation gasket (29) are in a ring shape and are sequentially sleeved on the outer electrode (25), one end of the heat-insulation support (28) abuts against the heat-insulation gasket (29), the other end of the heat-insulation support (28) abuts and fixes the heating element (23) on the outside of the bottom of the pipe bowl container (21).

5. The evaporator according to claim 3, wherein the evaporator (1000) further comprises an electrode outside of bracket (40*a*) and an electrode inside of bracket (40*b*) arranged in isolation, one end of the electrode outside of bracket (40*a*) is electrically connected with the outer electrode (25), one end of the electrode inside of bracket (40*b*) is electrically connected with the inner electrode (24), the other end of the electrode outside of bracket (40*a*) and the other end of the electrode inside of bracket (40*b*) are electrically connected with the battery cell (100) and the control circuit (90); and a ceramic air passage structure (50) is detachably connected inside the electrode inside of bracket (40*b*), one end of the ceramic air passage structure (50) is communicated with the second air passage (222), the other end of the ceramic air passage structure (50) is connected with a hollow connector (60) configured for connecting with a shisha.

6. The evaporator according to claim 1, wherein one side of an opening end of the pipe bowl container (21) is provided with a magnetic attraction part (31) which can be used for magnetic suction connection with a cover body (70), the magnetic attraction part (31) is supported by a top of the heating core shell (10) and is extruded and connected with an inner wall of the heating core shell (10), a heat-insulation ring (32) is provided between the magnetic attraction part (31) and the opening end of the pipe bowl container (21); the cover body (70) is provided with an air inlet (72) communicated with the cavity air passage structure (22).

7. The evaporator according to claim 1, wherein the evaporator (1000) further comprises a housing (80) and a switch assembly (110) arranged on the housing (80), the switch assembly (110) comprises a switch button (111) and a display touch button (112), the switch button (111) and the display touch button (112) are electronically connected with the control circuit (90), the control circuit (90) can receive any triggering command of the switch button (111) and the display touch button (112).

8. The evaporator according to claim 7, wherein the evaporator (1000) further comprises a motor (160) arranged inside the housing (80), the motor (160) is electrically connected with the control circuit (90), the control circuit (90) is configured to output a control signal to the motor (160) according to a heating temperature of the heating element (23) to control a vibration of the motor (160), and to indicate a heating working state of the heating element (23).

9. The evaporator according to claim 8, wherein the evaporator (1000) further comprises a current sampling circuit (170) and an amplifier (180);

one end of the current sampling circuit (170) is electronically connected with the heating element (23), the other end of the current sampling circuit (170) is electronically connected with the amplifier (180), the amplifier (180) is electronically connected with the control circuit (90); and the current sampling circuit (170) is configured to obtain a current signal of the heating element (23), the amplifier (180) is configured to amplify the current signal obtained, and the current signal amplified by the amplifier (180) is transmitted to the control circuit (90).

10. A control method for the evaporator according to claim 1, comprising:

step S100: receiving a trigger signal from one of different trigger paths, the trigger paths at least comprise a switch key (111) triggering and a display touch key (112) triggering;

step S200: controlling a working state of the heating element (23) according to the trigger signal; and step S300: obtaining a heating temperature of the heating element (23), and controlling a vibration state of a motor (160) according to the heating temperature of the heating element (23) to indicate a heating working state of the heating element (23) and automatically adjust a temperature of the heating element (23).

* * * * *